US009440327B2

(12) United States Patent
Hiroo et al.

(10) Patent No.: US 9,440,327 B2
(45) Date of Patent: Sep. 13, 2016

(54) POLISHING APPARATUS AND POLISHING METHOD

(71) Applicant: Ebara Corporation, Tokyo (JP)

(72) Inventors: Yasumasa Hiroo, Tokyo (JP); Yoichi Kobayashi, Tokyo (JP); Katsutoshi Ono, Tokyo (JP)

(73) Assignee: Ebara Corporation, Tokyo (JP)

( * ) Notice: Subject to any disclaimer, the term of this patent is extended or adjusted under 35 U.S.C. 154(b) by 554 days.

(21) Appl. No.: 13/859,496

(22) Filed: Apr. 9, 2013

(65) Prior Publication Data

US 2013/0344773 A1 Dec. 26, 2013

(30) Foreign Application Priority Data

Apr. 10, 2012 (JP) ..... 2012-89585

(51) Int. Cl.

| | |
|---|---|
| ***B24B 1/00*** | (2006.01) |
| ***B24B 49/10*** | (2006.01) |
| ***B24B 49/12*** | (2006.01) |
| ***B24B 49/16*** | (2006.01) |
| ***B24B 37/013*** | (2012.01) |

(52) U.S. Cl.

CPC ..... *B24B 37/013* (2013.01); *B24B 1/002* (2013.01); *B24B 49/10* (2013.01); *B24B 49/12* (2013.01); *B24B 49/16* (2013.01)

(58) Field of Classification Search

CPC ..... B24B 1/00; B24B 1/002; B24B 49/00; B24B 49/006; B24B 49/02; B24B 49/03; B24B 49/04; B24B 49/05; B24B 49/10; B24B 49/105; B24B 49/12; B24B 49/16; B24B 37/013

USPC ..... 451/5, 6, 8, 41, 285–290

See application file for complete search history.

(56) References Cited

U.S. PATENT DOCUMENTS

| | | | | |
|---|---|---|---|---|
| 6,257,953 | B1 * | 7/2001 | Gitis et al. | 451/5 |
| 6,494,765 | B2 * | 12/2002 | Gitis et al. | 451/5 |
| 6,602,110 | B2 * | 8/2003 | Yi et al. | 451/9 |
| 6,623,334 | B1 * | 9/2003 | Birang et al. | 451/10 |
| 6,741,913 | B2 * | 5/2004 | Wang et al. | 700/275 |
| 7,156,717 | B2 * | 1/2007 | Molnar | 451/5 |
| 7,960,188 | B2 | 6/2011 | Ohta | |
| 2003/0008597 | A1 * | 1/2003 | Tseng | B24B 37/013 451/6 |
| 2004/0180610 | A1 * | 9/2004 | Togawa | B24B 37/30 451/41 |

(Continued)

FOREIGN PATENT DOCUMENTS

| | | |
|---|---|---|
| JP | 06-315850 | 11/1994 |
| JP | 2001-198813 | 7/2001 |

(Continued)

*Primary Examiner* — Monica Carter
*Assistant Examiner* — Marcel Dion
(74) *Attorney, Agent, or Firm* — Baker & Hostetler LLP

(57) ABSTRACT

The present invention provides an apparatus and a method for polishing a substrate having a film formed thereon. The method includes: rotating a polishing table supporting a polishing pad by a table motor; pressing the substrate against the polishing pad by a top ring; obtaining a signal containing a thickness information of the film; producing from the signal a polishing index value that varies in accordance with a thickness of the film; monitoring a torque current value of the table motor and the polishing index value; and determining a polishing end point based on a point of time when the torque current value has reached a predetermined threshold value or a point of time when a predetermined distinctive point of the polishing index value has appeared, whichever comes first.

10 Claims, 12 Drawing Sheets

(56) References Cited

U.S. PATENT DOCUMENTS

2005/0070206 A1* 3/2005 Kasiraj ..... B24B 37/00 451/5
2005/0142991 A1* 6/2005 Nakao ..... B24B 37/013 451/64
2008/0242197 A1* 10/2008 Fujita ..... H01L 22/26 451/8
2009/0130956 A1* 5/2009 Ohta ..... B24B 37/005 451/6
2010/0093260 A1* 4/2010 Kobayashi ..... B24B 49/12 451/5
2011/0216328 A1* 9/2011 Kobayashi ..... B24B 37/013 356/630
2011/0269377 A1* 11/2011 Qian ..... B24B 37/013 451/5
2011/0301847 A1* 12/2011 David ..... B24B 37/013 702/1

FOREIGN PATENT DOCUMENTS

JP 2004-154928 6/2004
JP 2004-327561 A 11/2004
JP 2005-011977 1/2005
JP 2005-277396 A 10/2005
JP 2009-196002 A 9/2009
JP 2011-205070 A 10/2011
JP 2012-004276 A 1/2012

* cited by examiner

FIG. 2
FIG. 2A
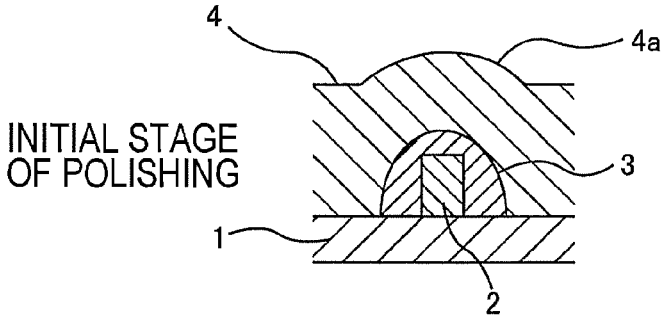
FIG. 2B
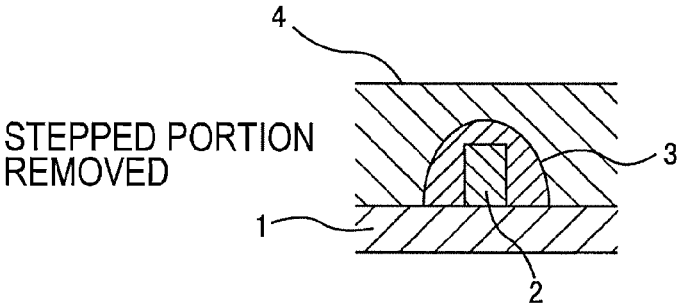
FIG. 2C
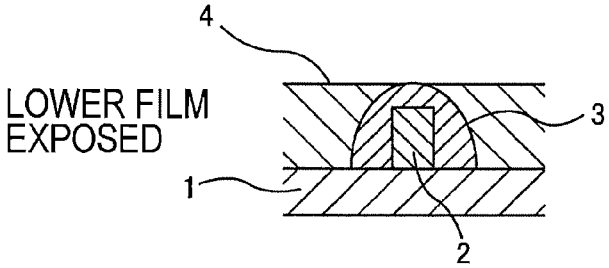
FIG. 2D
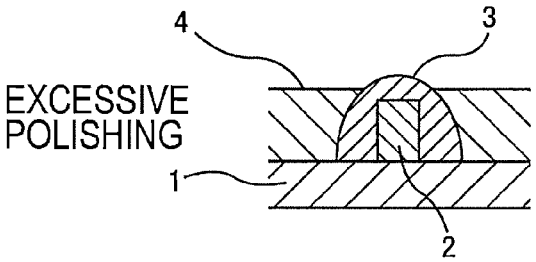

POLISHING APPARATUS AND POLISHING METHOD

CROSS REFERENCE TO RELATED APPLICATIONS

This application claims priority to Japanese Patent Application No. 2012-89585 filed Apr. 10, 2012, the entire contents of which are hereby incorporated by reference.

BACKGROUND OF THE INVENTION

1. Field of the Invention

The present invention relates to a polishing apparatus and a polishing method for a substrate, such as a wafer, and more particularly to a polishing apparatus and a polishing method capable of detecting a polishing end point of a substrate.

2. Description of the Related Art

Various types of polishing end point detection methods have been used in apparatus for polishing a substrate, such as a wafer. For example, in order to detect a point at which an upper film is removed by polishing of it and as a result a lower film is exposed, a method of detecting a change in a torque current of a polishing table is used (for example, see Japanese laid-open patent publication No. 2001-198813 and Japanese laid-open patent publication No. 6-315850).

As interconnects have been becoming finer, a more accurate detection of the polishing end point is required. However, the above-mentioned method of detecting the polishing end point based on the torque current may result in excessive polishing of a wafer if there is a variety in thickness of the upper film over the wafer surface. Specifically, if the wafer is polished until the lower film is exposed over the wafer surface in its entirety, the lower film may be polished excessively with respect to a target film thickness.

In order to prevent such excessive polishing, there is proposed a method in which the wafer is polished for a predetermined time from a point at which removal of initial irregularities formed on a surface of the upper film is detected from the change in the torque current. This method includes the steps of terminating polishing of the wafer when the remaining lower film is thicker than its target thickness, measuring the film thickness in an exterior film thickness measuring device, calculating a polishing time necessary to eliminate a difference between the target film thickness and the measured film thickness, and additionally polishing the wafer for the calculated polishing time to achieve the target film thickness. However, this method includes the additional polishing of the wafer, which increases a whole polishing time and lowers a throughput.

Other than the method of detecting the polishing end point based on the torque current, there is a method of detecting the polishing end point using an optical sensor (for example, see Japanese laid-open patent publication No. 2004-154928). This type of method includes the steps of directing a light at the surface of the wafer, and analyzing a reflected light from the wafer to determine the polishing end point of the wafer. According to this method, it is possible to terminate polishing of the wafer before the lower film is exposed, because the polishing end point is detected from a polished state of the upper film. However, interconnect patterns formed in the wafer or slurry used in the polishing of the wafer may adversely affect the accuracy of the polishing end point detection, and as a result the required accuracy may not be achieved.

SUMMARY OF THE INVENTION

The present invention has been made in view of the above drawbacks. It is therefore an object of the present invention to provide a polishing apparatus and a polishing method capable of preventing excessive polishing and improving an accuracy of a polishing end point detection.

One aspect of the present invention for achieving the above object is a polishing apparatus for polishing a substrate having a film formed thereon. The apparatus includes: a polishing table for supporting a polishing pad; a table motor configured to rotate the polishing table; a top ring configured to press the substrate against the polishing pad; a sensor configured to obtain a signal containing a thickness information of the film; and a processor configured to produce from the signal a polishing index value that varies in accordance with a thickness of the film, the processor being configured to monitor a torque current value of the table motor and the polishing index value and determine a polishing end point based on a point of time when the torque current value has reached a predetermined threshold value or a point of time when a predetermined distinctive point of the polishing index value has appeared, whichever comes first.

In a preferred aspect of the present invention, the processor stores therein a first detection error range determined from a difference between a predetermined target film thickness and a film thickness when the predetermined distinctive point of the polishing index value has appeared, and a second detection error range determined from a difference between the predetermined target film thickness and a film thickness when the torque current value has reached the predetermined threshold value; each of the first detection error range and the second detection error range is a detection error range obtained from historical polishing data with respect to a substrate which is the same type as the substrate to be originally polished; and the predetermined threshold value is set such that the second detection error range overlaps with the first detection error range.

In a preferred aspect of the present invention, the processor is configured to determine the polishing end point which is either the point of time when the torque current value has reached the predetermined threshold value or the point of time when the predetermined distinctive point of the polishing index value has appeared, whichever comes first.

In a preferred aspect of the present invention, the processor is configured to determine the polishing end point which is a point of time when a predetermined time has elapsed from either the point of time when the torque current value has reached the predetermined threshold value or the point of time when the predetermined distinctive point of the polishing index value has appeared, whichever comes first.

In a preferred aspect of the present invention, the sensor is an optical sensor configured to irradiate the substrate with light and measure intensity of reflected light from the substrate, and the processor is configured to produce the polishing index value from the intensity of the reflected light.

Another aspect of the present invention is a polishing method for polishing a substrate having a film formed thereon. The method includes: rotating a polishing table supporting a polishing pad by a table motor; pressing the substrate against the polishing pad by a top ring; obtaining a signal containing a thickness information of the film; producing from the signal a polishing index value that varies in accordance with a thickness of the film; monitoring a torque current value of the table motor and the polishing index value; and determining a polishing end point based on a point of time when the torque current value has reached a predetermined threshold value or a point of time when a predetermined distinctive point of the polishing index value has appeared, whichever comes first.

In a preferred aspect of the present invention, the predetermined threshold value is set such that a second detection error range overlaps with a first detection error range; the first detection error range is determined from a difference between a predetermined target film thickness and a film thickness when the predetermined distinctive point of the polishing index value has appeared, and the second detection error range is determined from a difference between the predetermined target film thickness and a film thickness when the torque current value has reached the predetermined threshold value; and each of the first detection error range and the second detection error range is a detection error range obtained from historical polishing data with respect to a substrate which is the same type as the substrate to be originally polished.

In a preferred aspect of the present invention, the determining of the polishing end point comprises determining the polishing end point which is either the point of time when the torque current value has reached the predetermined threshold value or the point of time when the predetermined distinctive point of the polishing index value has appeared, whichever comes first.

In a preferred aspect of the present invention, the determining of the polishing end point comprises determining the polishing end point which is a point of time when a predetermined time has elapsed from either the point of time when the torque current value has reached the predetermined threshold value or the point of time when the predetermined distinctive point of the polishing index value has appeared, whichever comes first.

In a preferred aspect of the present invention, the detection of the thickness of the film comprises irradiating the substrate with light and measuring intensity of reflected light from the substrate, and the producing of the polishing index value comprises producing the polishing index value from the intensity of the reflected light.

According to the present invention, the polishing end point is detected with use of both the torque current value of the table motor and the optical signal from the optical sensor. Therefore, the polishing end point can be detected before the substrate is polished excessively. Accordingly, it is possible to improve the accuracy of the polishing end point detection.

BRIEF DESCRIPTION OF THE DRAWINGS

FIG. 2A through 2D are views illustrating a progress of wafer polishing;

DETAILED DESCRIPTION OF THE PREFERRED EMBODIMENTS

Embodiments of the present invention will be described below with reference to the drawings.

Figure 1:
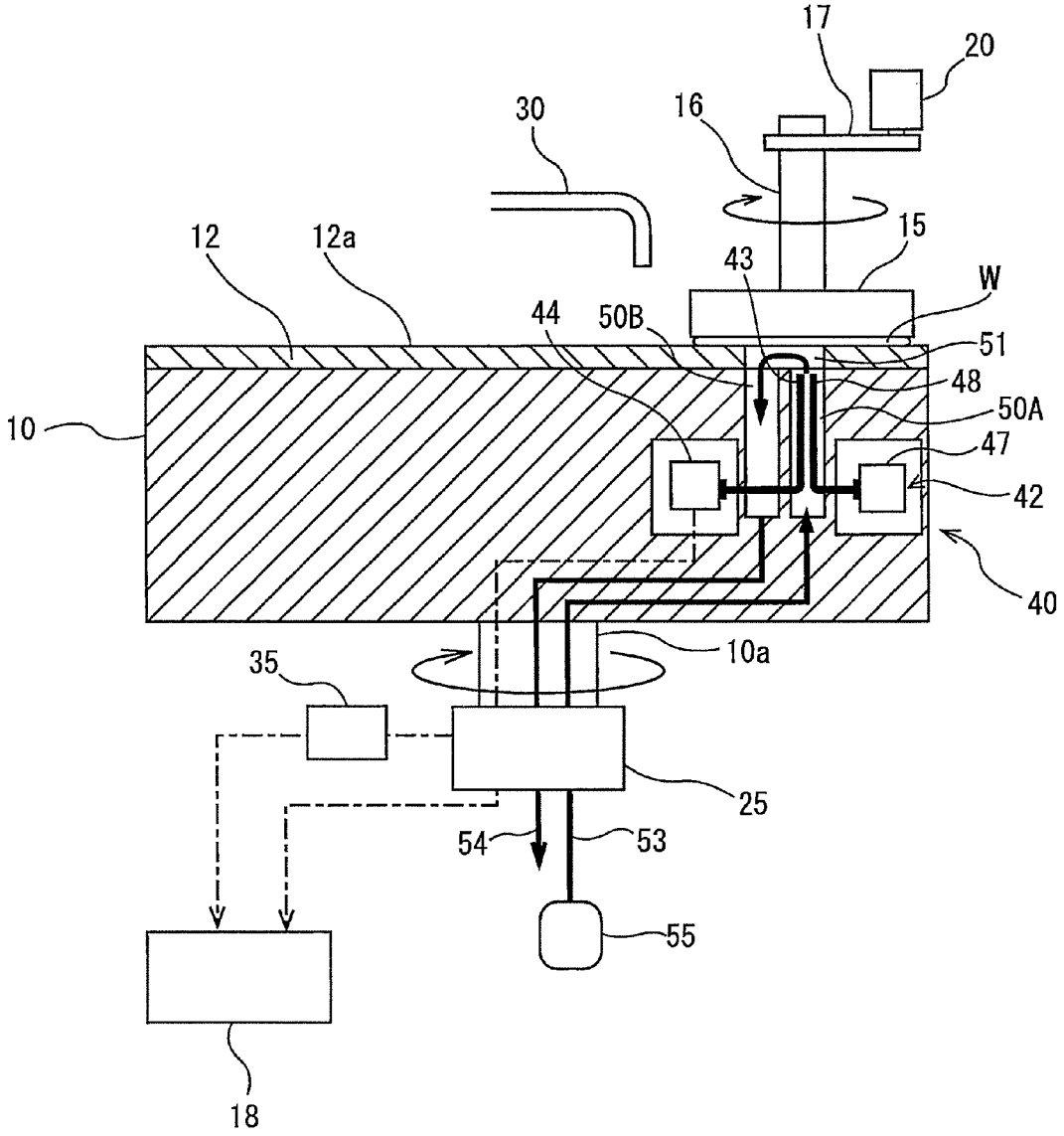
FIG. 1 is a polishing apparatus according to an embodiment of the present invention.

FIG. 1 is a view of a polishing apparatus according to an embodiment of the present invention. As shown in FIG. 1, the polishing apparatus has a polishing table 10, a top ring 15 supported by a top ring shaft 16, and a processer 18 for detecting a polishing end point of a wafer (substrate) W based on various data. The top ring 15 is configured to hold the wafer W on its lower surface. The top ring shaft 16 is coupled to a top ring motor 20 through a coupling device 17, such as a belt, so that the top ring shaft 16 is rotated by the top ring motor 20. This rotation of the top ring shaft 16 in turn rotates the top ring 15 as indicated by arrow.

The polishing table 10 is coupled to a table motor 25 through a table shaft 10*a*, so that the polishing table 10 is rotated by the table motor 25 in a direction as illustrated by arrow. The table motor 25 is located below the polishing table 10. A polishing pad 12 is attached to an upper surface of the polishing table 10. This polishing pad 12 has an upper surface 12*a* which provides a polishing surface for polishing the wafer W.

The top ring shaft 16 is elevated and lowered by an elevating mechanism (not shown in the drawing). The top ring 15, holding the wafer W on its lower surface, is lowered by the top ring shaft 16 and presses the wafer W against the upper surface (i.e., the polishing surface) 12*a* of the polishing pad 12. During polishing of the wafer W, the top ring 15 and the polishing table 10 are rotated, while a polishing liquid (i.e., slurry) is supplied onto the polishing pad 12 from a polishing liquid supply nozzle 30 arranged above the polishing table 10. The surface of the wafer W is polished by a mechanical action of abrasive grains contained in the polishing liquid and a chemical action of the polishing liquid.

During polishing of the wafer W, the surface of the wafer W and the polishing surface 12*a* of the polishing pad 12 are placed in sliding contact with each other. Therefore, a frictional force is generated between the wafer W and the polishing pad 12. This frictional force varies depending on a shape of an exposed surface of the wafer W and a type of film that forms the exposed surface of the wafer W. For example, when an upper film is removed by the polishing of it and as a result a lower film is exposed, the frictional force between the wafer W and the polishing pad 12 changes.

The table motor 25 is controlled so as to rotate the polishing table 10 at a preset constant speed. Therefore, when the frictional force acting between the wafer W and the polishing pad 12 changes, a value of a current (i.e., a torque current) flowing into the table motor 25 also changes. More specifically, the larger the frictional force, the larger the torque current required to induce a greater torque for rotating the polishing table 10. The smaller the frictional force, the smaller the torque current required to induce a smaller torque for rotating the polishing table 10. An ammeter 35 for measuring the torque current is coupled to the table motor 25. Instead of providing the ammeter 35, a current value outputted from an inverter (not shown) for driving the table motor 25 may be used for monitoring the torque current.

Figure 3:
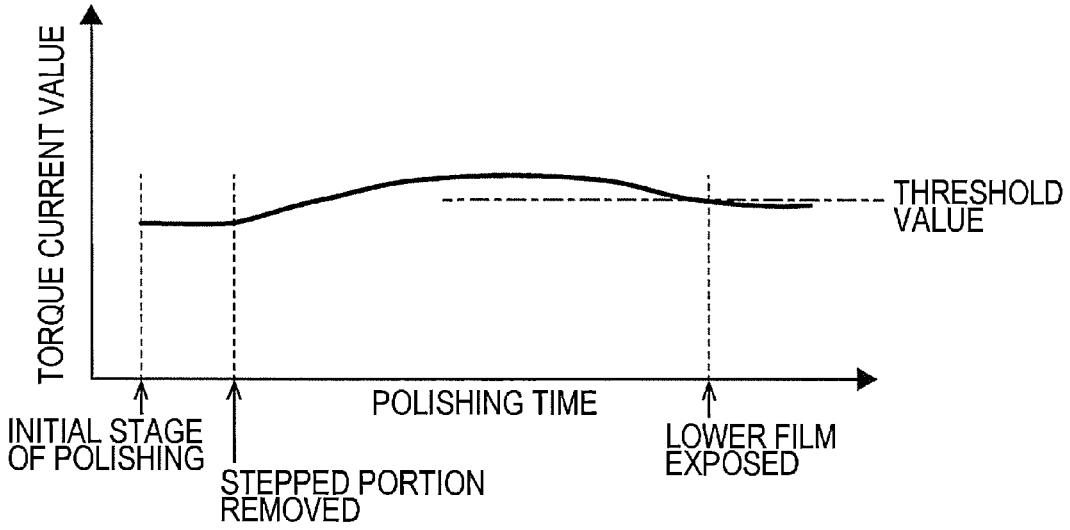
FIG. 3 is a diagram illustrating a manner of a change in a torque current in accordance with the progress of wafer polishing.

FIG. 2A through FIG. 2D are views illustrating progress of the polishing process of the wafer. FIG. 3 is a diagram illustrating a manner of the change in the torque current according to the progress of the polishing process of the wafer. As shown in FIG. 2A, a multilayer structure is constituted by a silicon layer 1, polysilicon 2 formed on the silicon layer 1, a silicon nitride 3 covering the polysilicon 2, and a dielectric film 4 formed on the silicon nitride 3. In polishing of this wafer, the dielectric film 4, which is the upper film, is polished until the silicon nitride 3, which is the lower film, appears on the wafer surface. Therefore, the polishing end point of this wafer is a point at which the silicon nitride 3 is exposed. The polishing liquid used in this polishing process has chemical characteristics that accelerate polishing of the dielectric film 4 and suppress polishing of the silicon nitride 3.

In an initial polishing stage, an upper surface of the dielectric film 4 has a stepped portion 4*a* which is formed along a shape of the silicon nitride 3. Due to the presence of this stepped portion 4*a*, a contact area between the wafer and the polishing pad 12 is small. Therefore, the frictional force generated between the wafer and the polishing pad 12 is also small. As shown in FIG. 2B, when the stepped portion 4*a* of the dielectric film 4 is removed as the polishing of the wafer progresses, the contact area between the wafer and the polishing pad 12 increases and the frictional force generated between the wafer and the polishing pad 12 also increases. Therefore, the torque current increases. When the polishing of the wafer further progresses, the silicon nitride 3 appears on the wafer surface, as shown in FIG. 2C. When the silicon nitride 3 is exposed, the frictional force decreases. This is because the polishing liquid used has the chemical characteristics that suppress polishing of the silicon nitride 3.

When the silicon nitride 3 is exposed, the torque current decreases. The polishing end point of the wafer can be determined based on this point of change in the torque current. Specifically, as shown in FIG. 3, a point at which the torque current is lowered to reach a preset threshold value is determined to be the polishing end point. However, there is a variation in thickness of the dielectric film (i.e., the upper film) 4 within the wafer surface. In such a case, if the wafer is polished until the silicon nitride (i.e., the lower film) 3 appears over the wafer surface in its entirety, the wafer may be excessively polished as shown in FIG. 2D.

Thus, a combination of the polishing end point detection based on the torque current and the polishing end point detection with use of an optical sensor 40 is used in this embodiment. As shown in FIG. 1, the optical sensor 40 is embedded in the polishing table 10 and is rotated together with the polishing table 10. The optical sensor 40 is configured to irradiate the surface of the wafer W with light and measure an intensity of the reflected light at each of wavelengths thereof.

The optical sensor 40 includes an irradiator 42 for irradiating the surface, to be polished, of the wafer W with the light, an optical fiber 43 as an optical receiver for receiving the reflected light from the wafer W, and a spectrometer 44 configured to break up the reflected light according to the wavelength and measure the intensity of the reflected light over a predetermined wavelength range.

The polishing table 10 has a first hole 50A and a second hole 50B having upper open ends lying in the upper surface of the polishing table 10. The polishing pad 12 has a through-hole 51 at a position corresponding to the holes 50A and 50B. The holes 50A and 50B are in fluid communication with the through-hole 51, which has an upper open end lying in the polishing surface 12*a*. The first hole 50A is coupled to a liquid supply source 55 via a liquid supply passage 53 and a rotary joint (not shown). The second hole 50B is coupled to a liquid discharge passage 54.

The irradiator 42 includes a light source 47 for emitting multiwavelength light and an optical fiber 48 coupled to the light source 47. The optical fiber 48 is an optical transmission element for directing the light, emitted by the light source 47, to the surface of the wafer W. Tip ends of the optical fiber 48 and the optical fiber 43 lie in the first hole 50A and are located near the surface, to be polished, of the wafer W. The tip ends of the optical fiber 48 and the optical fiber 43 are arranged so as to face the wafer W held by the top ring 15, so that multiple zones, including the center, of the wafer W are irradiated with the light each time the polishing table 10 makes one revolution.

During polishing of the wafer W, the liquid supply source 55 supplies water (preferably pure water) as a transparent liquid into the first hole 50A through the liquid supply passage 53. The water fills a space formed between the lower surface of the wafer W and the tip ends of the optical fibers 48 and 43. The water further flows into the second hole 50B and is expelled therefrom through the liquid discharge passage 54. The polishing liquid is discharged together with the water and thus a path of light is secured. The liquid supply passage 53 is provided with a valve (not shown in the drawing) configured to operate in conjunction with the rotation of the polishing table 30A. The valve operates so as to stop the flow of the water or reduce the flow of the water when the wafer W is not located over the through-hole 51.

The optical fiber 48 and the optical fiber 43 are arranged in parallel with each other. The tip ends of the optical fiber 48 and the optical fiber 43 are perpendicular to the surface of the wafer W, so that the optical fiber 48 directs the light at the surface of the wafer W perpendicularly.

During polishing of the wafer W, the irradiator 42 irradiates the wafer W with the light, and the optical fiber (optical receiver) 43 receives the light reflected from the wafer W. The spectrometer 44 measures the intensity of the reflected light at each of the wavelengths over the predetermined wavelength range and sends light intensity data to the processor 18. Measured values of the intensity of the reflected light obtained by the spectrometer 44 are signals that contain information of the film thickness of the wafer W and vary in accordance with the film thickness. The processor 18 produces a spectral waveform showing the light intensities at the respective wavelengths from the light intensity data, and further produces a polishing index value representing the polishing progress of the wafer W from the spectral waveform.

Figure 4:
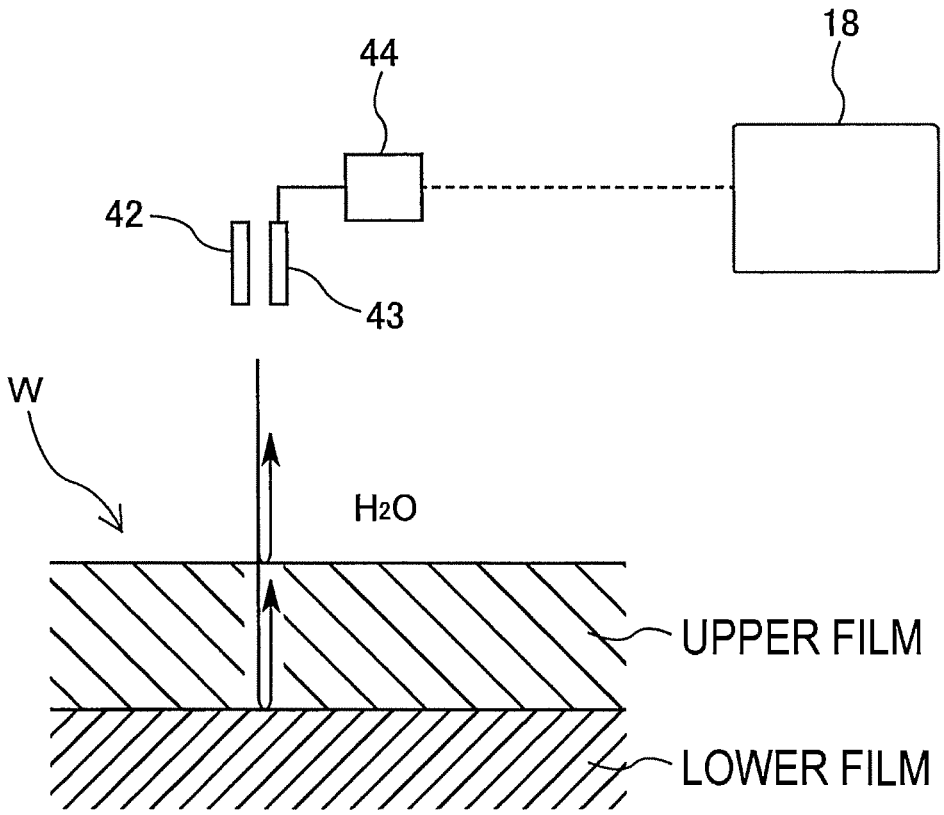
FIG. 4 is a schematic view illustrating the principle of an optical sensor.
Figure 5:
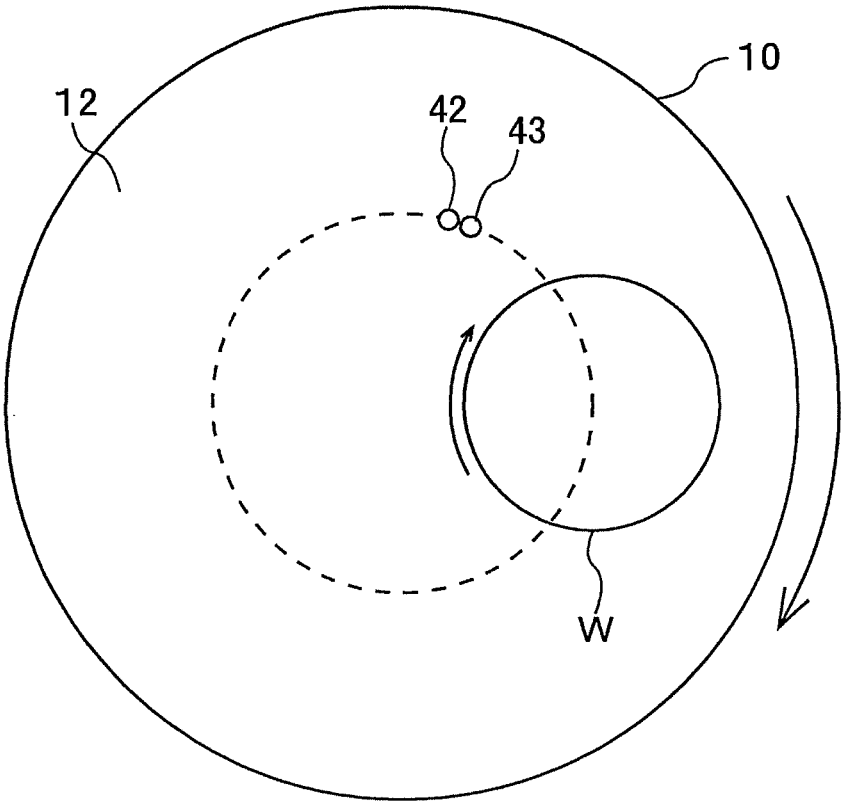
FIG. 5 is a plan view showing a positional relationship between the wafer and a polishing table.

FIG. 4 is a schematic view illustrating the principle of the optical sensor 40, and FIG. 5 is a plan view showing a positional relationship between the wafer W and the polishing table 10. In this example shown in FIG. 4, the wafer W has a lower film and an upper film formed on the lower film. The irradiator 42 and the optical receiver 43 are arranged so as to face the surface of the wafer W. The irradiator 42 is configured to irradiate the multiple zones, including the center, of the wafer W, with the light each time the polishing table 10 makes one revolution.

The light incident on the wafer W is reflected off an interface between a medium (e.g., water in the example of FIG. 4) and the upper film and an interface between the upper film and the lower film. Light waves from these interfaces interfere with each other. The manner of interference between the light waves varies according to the thickness of the upper film (i.e., a length of an optical path). As a result, the spectral waveform, produced from the reflected light from the wafer, varies according to the thickness of the upper film. The spectrometer 44 breaks up the reflected light according to the wavelength and measures the intensity of the reflected light at each of the wavelengths. The processor 18 produces the spectral waveform from the intensity data of the reflected light obtained from the spectrometer 44. This spectral waveform is expressed as a line graph (i.e., a waveform) indicating a relationship between the wavelength and the intensity of the light. The intensity of the light can also be expressed as a relative value, such as a reflectance or a relative reflectance.

Figure 6:
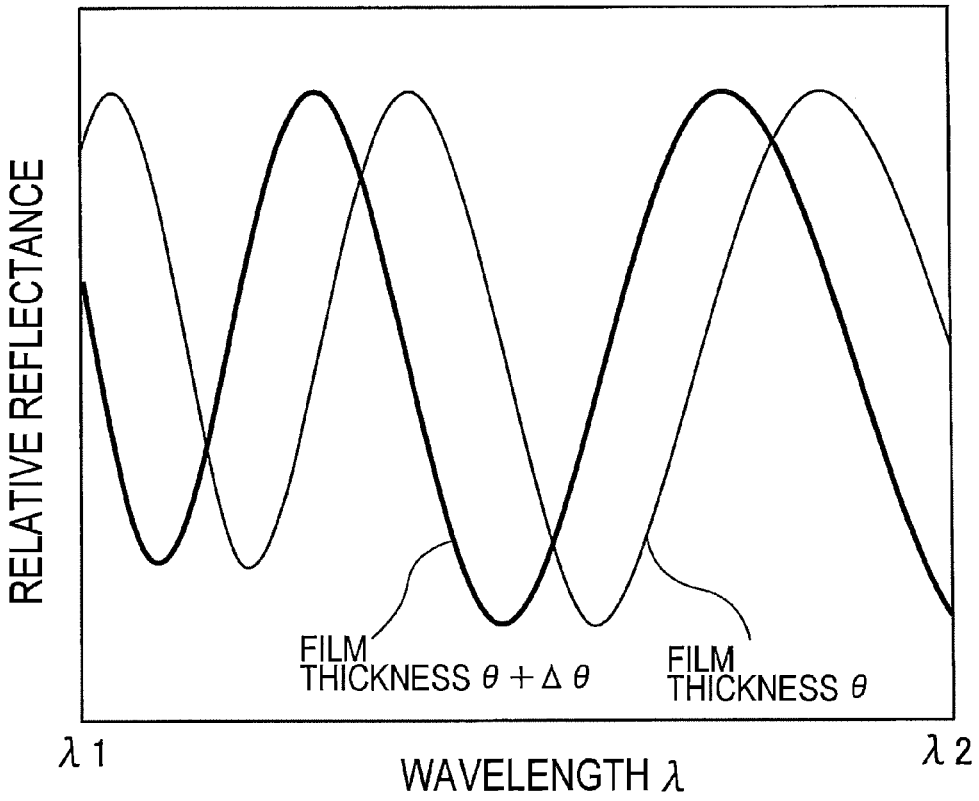
FIG. 6 is a diagram showing a spectral waveform created by a processor.

FIG. 6 is a diagram showing the spectral waveform created by the processor 18. In FIG. 6, horizontal axis represents the wavelength of the reflected light, and vertical axis represents relative reflectance derived from the intensity of the light. The relative reflectance is an index that represents the intensity of the reflected light. More specifically, the relative reflectance is a ratio of the intensity of the reflected light to predetermined reference intensity. By dividing the intensity of the light (i.e., the actually measured intensity) by the corresponding reference intensity at each of the wavelengths, unwanted noises, such as a variation in the intensity inherent in an optical system or the light source, are removed from the actually measured intensity. As a result, the spectral waveform reflecting only the thickness information of the upper film can be obtained.

The reference intensity is an intensity obtained in advance at each of the wavelengths. The relative reflectance is calculated at each of the wavelengths. Specifically, the relative reflectance is determined by dividing the intensity of the light (i.e., the actually measured intensity) at each wavelength by the corresponding reference intensity. The predetermined reference intensity may be intensity of the reflected light obtained when a silicon wafer (bare wafer) with no film thereon is being polished in the presence of water. In the actual polishing process, the relative reflectance is obtained as follows. A dark level (which is a background intensity obtained under the condition that the light is cut off) is subtracted from the actually measured intensity to determine a corrected actually measured intensity. Further, the dark level is subtracted from the reference intensity to determine a corrected reference intensity. Then the relative reflectance is calculated by dividing the corrected actually measured intensity by the corrected reference intensity. That is, the relative reflectance R(λ) can be calculated by using the following equation (1).

$$R(\lambda) = \frac{E(\lambda) - D(\lambda)}{B(\lambda) - D(\lambda)} \tag{1}$$

where λ is wavelength, E(λ) is the intensity of the reflected light, B(λ) is the reference intensity, and D(λ) is the dark level (i.e., the intensity of the light obtained under the condition that the light is cut off).

The processor 18 produces the polishing index value (which is a spectral index) that indicates the polishing progress, with use of the following equation.

$$\text{Polishing index value } S(\lambda 1) = R(\lambda 1)/(R(\lambda 1) + R(\lambda 2) + \ldots + R(\lambda k)) \tag{2}$$

In this equation (2), λ represents a wavelength of the light, and R (λk) represents a relative reflectance at a wavelength λk. The number of wavelengths λ to be used in calculation of the polishing index value is preferably two or three (i.e., k=2 or 3). As can be seen from the equation (2), the relative reflectance is divided by another relative reflectance. This operation can remove noise components, which is generated regardless of the wavelength, from the relative reflectance. Therefore, the polishing index value with no noise can be obtained.

Figure 7:
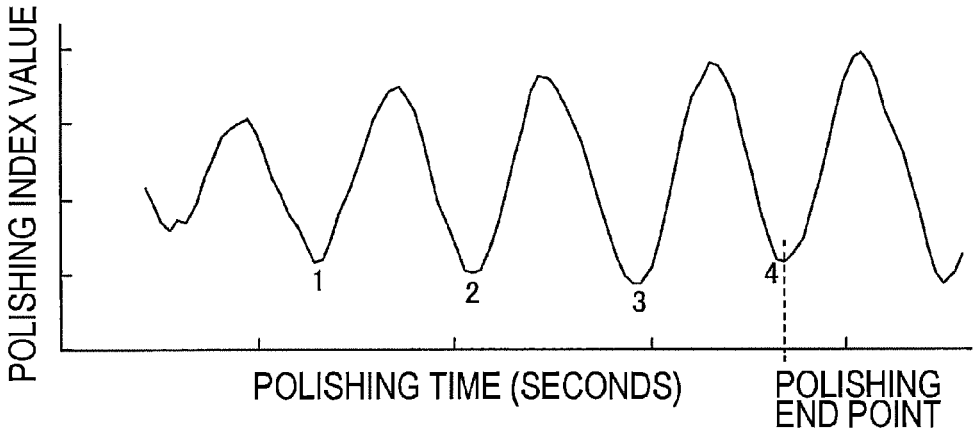
FIG. 7 is a graph showing a polishing index value produced from the spectral waveform.

FIG. 7 is a graph showing the polishing index value. As shown in FIG. 7, the polishing index value varies periodically with a polishing time. This is a phenomenon due to the interference of the light waves. The light, directed at the wafer W, is reflected off the interface between the medium and the upper film and the interface between the upper film and the lower film. The light waves from these interfaces interfere with each other. The manner of interference between the light waves varies according to the thickness of the upper film (i.e., a length of an optical path). As a result, the polishing index value, which is produced from the spectral waveform, varies periodically according to the thickness of the upper film, i.e., the polishing time.

The processor 18 detects a local maximal point or a local minimal point (which will be collectively referred to as local extremal point) which is a distinctive point of the polishing index value, and determines the polishing end point based on a detection time of the local extremal point. In the example shown in FIG. 7, a point of time when a fourth local minimal point from a predetermined time is detected is determined to be the polishing end point. In another example, a point of time when a predetermined time has elapsed from a detection time of a predetermined local extremal point may be determined to be the polishing end point.

Figure 8:
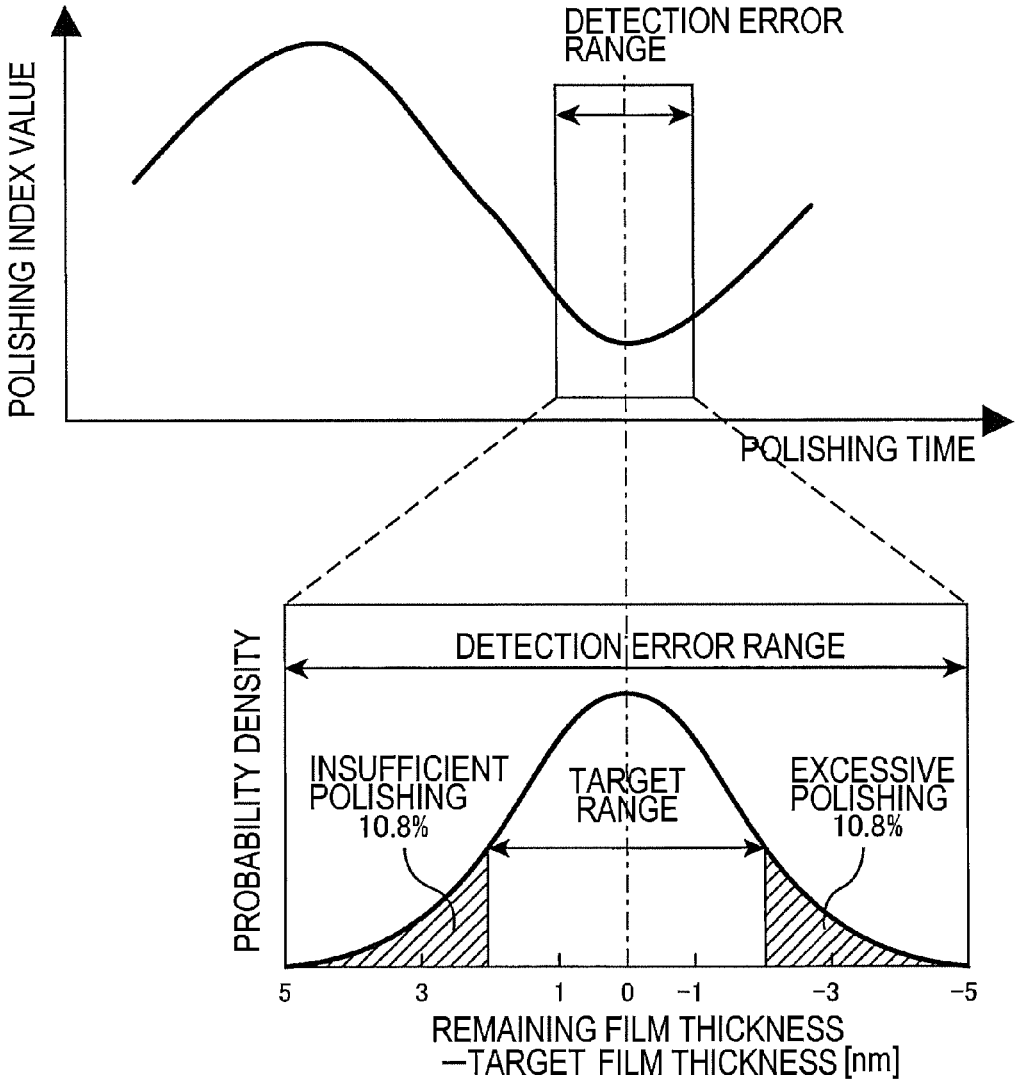
FIG. 8 is a graph describing a detection error range as a normal distribution.

The polishing end point detection with use of the optical sensor 40 entails a detection error due to various factors, such as a variation in the thickness of the lower film or a depth of trenches, and a variation in optical constant. When highly-accurate polishing end point detection is required, the thickness of the polished film may not fall within an allowable range, resulting in insufficient polishing or excessive polishing as shown in FIG. 8. In the example shown in FIG. 8, an allowable target range is plus or minus 2 nm with respect to a target film thickness, while a detection error range is plus or minus 5 nm with respect to the target film thickness. FIG. 8 shows a graph describing this detection error range as a normal distribution. In this example, a probability of the occurrence of the insufficient polishing and a probability of the occurrence of the excessive polishing are 10.8%.

Figure 9:
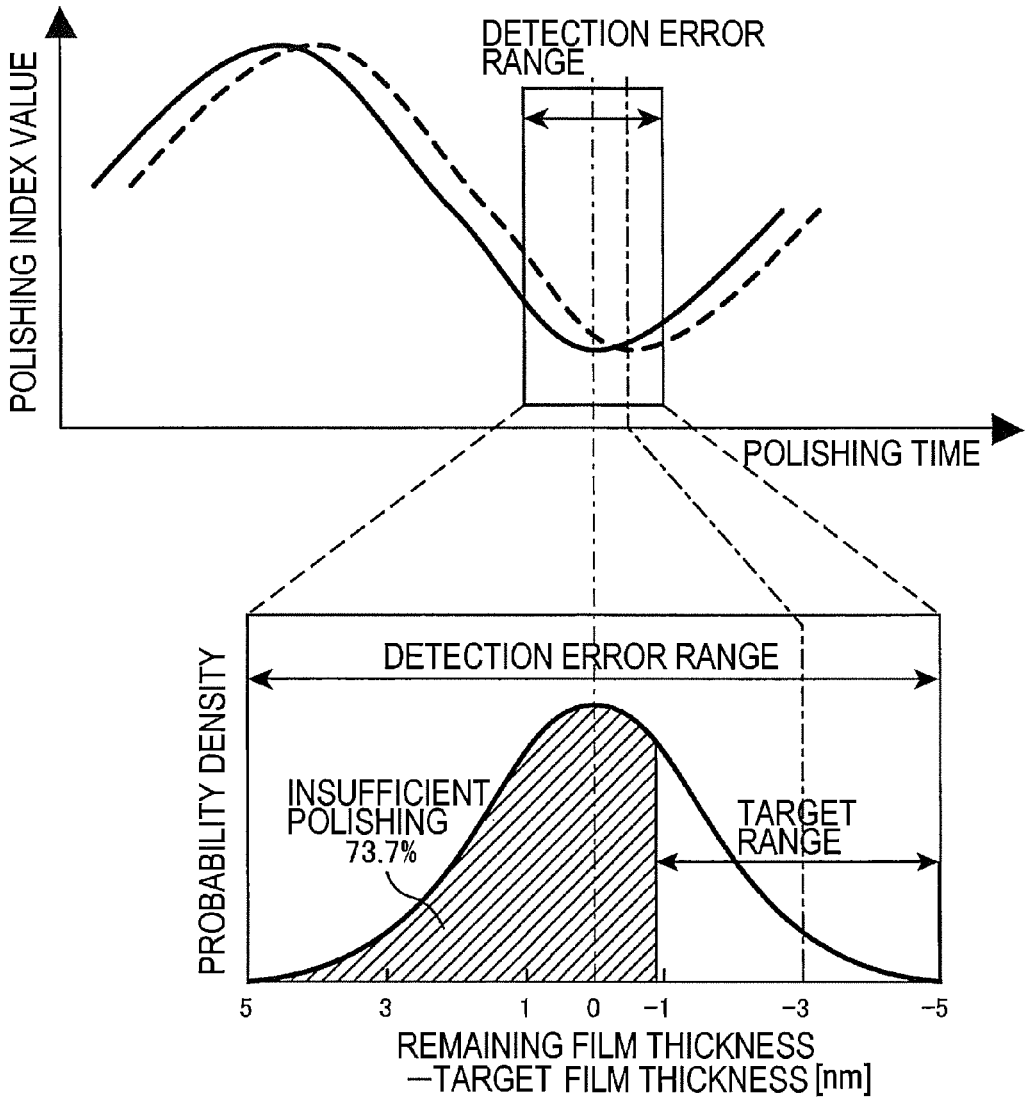
FIG. 9 is a diagram showing an example of a polishing end point detection.

The insufficient polishing can be solved by additionally polishing the wafer, but there is no way to solve the excessive polishing. As shown in FIG. 9, it is possible to prevent the excessive polishing by adjusting a recipe of the polishing end point detection such that the distinctive point of the polishing index value appears slightly early. However, in this case, the probability of the occurrence of the insufficient polishing increases up to 73.7%.

Figure 10:
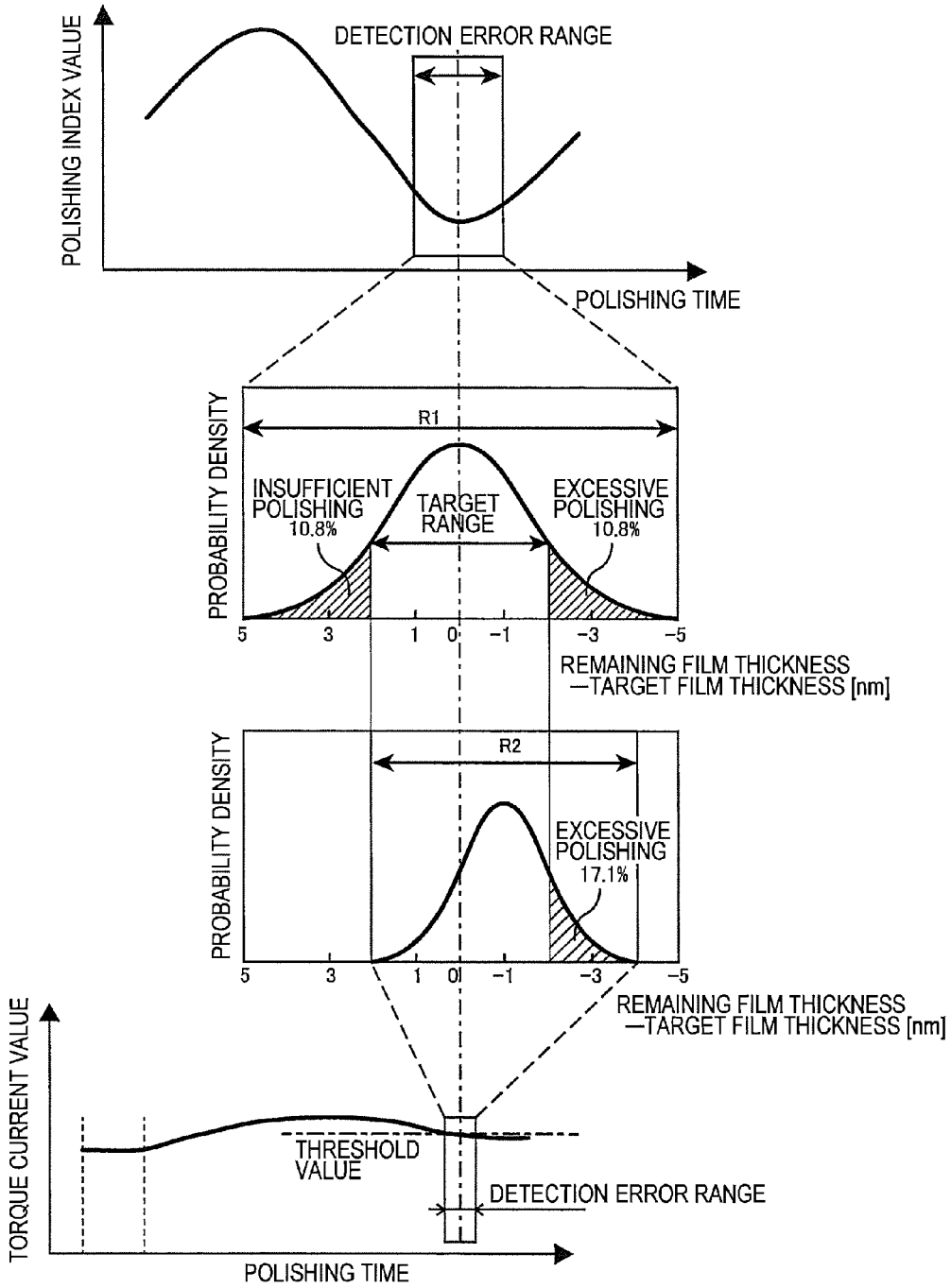
FIG. 10 is a diagram illustrating an embodiment of the polishing end point detection method according to the present invention.

Thus, in this embodiment, the combination of the polishing index value obtained from the optical sensor 40 and the table torque current value is used to detect the polishing end point of the wafer. FIG. 10 is a diagram illustrating an embodiment of the polishing end point detection method according to the present invention. As shown in FIG. 10, the polishing end point detection recipe for the optical sensor 40 is adjusted such that the distinctive point of the polishing index value appears when the film thickness of the wafer reaches the target film thickness as a result of polishing of the wafer.

The detection error exists not only in the polishing end point detection using the optical sensor 40, but also in the polishing end point detection based on the torque current value. The detection error in the polishing end point detection based on the torque current value may occur due to a variation in height of the silicon nitride surface within the wafer surface. Moreover, in many cases, the end point detection tends to be delayed because the torque current value does not change until a different film (e.g., the silicon nitride in the above example) is exposed. The detection error range of the optical sensor 40 (which will be hereinafter referred to as a first detection error range R1) and the detection error range of the polishing end point detection based on the torque current (which will be hereinafter referred to as a second detection error range R2) are set so as to overlap with each other. The position of the second detection error range R2 can be changed according to a threshold value of the torque current or a rate of change (i.e., a slope or derivative) in the torque current for the polishing end point detection. As shown in FIG. 10, it is preferable that the second detection error range R2 does not overlap with an insufficient polishing region and that most part of the second detection error range R2 lie within the target range.

During polishing of the wafer, the processor 18 monitors both the torque current value and the polishing index value and determines the polishing end point which is a point of time when the torque current value has reached the predetermined threshold value or a point of time when the distinctive point of the polishing index value has appeared, whichever comes first.

The first detection error range R1 is determined by polishing several wafers which are the same type as the wafer to be originally polished, measuring a film thickness of each wafer when the torque current value has reached the threshold value, with use of an external film-thickness measuring device, and calculating a difference between the measured film thickness and a predetermined target film thickness. Similarly, the second detection error range R2 is determined by polishing several wafers which are the same type as the wafer to be originally polished, measuring a film thickness of each wafer when the distinctive point of the polishing index value has appeared, with use of the external film-thickness measuring device, and calculating a difference between the measured film thickness and the predetermined target film thickness.

The first detection error range R1 and the second detection error range R2, both of which are obtained from historical polishing data in the above-described manner, are set so as to overlap with each other. Then, the processor 18 determines the wafer polishing end point at which either the torque current value or the polishing index value indicates the polishing end point first. In this manner, since both of the torque current value and the polishing index value are used to monitor the polishing progress, the probability of the excessive polishing is lowered and the polishing end point of the wafer can be determined more accurately.

According to FIG. 10, if the optical sensor and the torque current sensor (i.e., the end point detection using the torque current) are separately used, the excessive polishing is expected to occur with the probability of 10.8% and 17.1%, respectively. However, factors of the detection error in the respective sensors are different due to a difference in the detection principle. If either the optical sensor or the torque current sensor is used and fails to detect the end point in a timely manner, the excessive polishing may occur as a result of the detection failure. Even in such a case, both the optical sensor and the torque current sensor are unlikely to fail the end point detection simultaneously. This means that use of both sensors can lower the probability of the occurrence of the excessive polishing.

Figure 11:
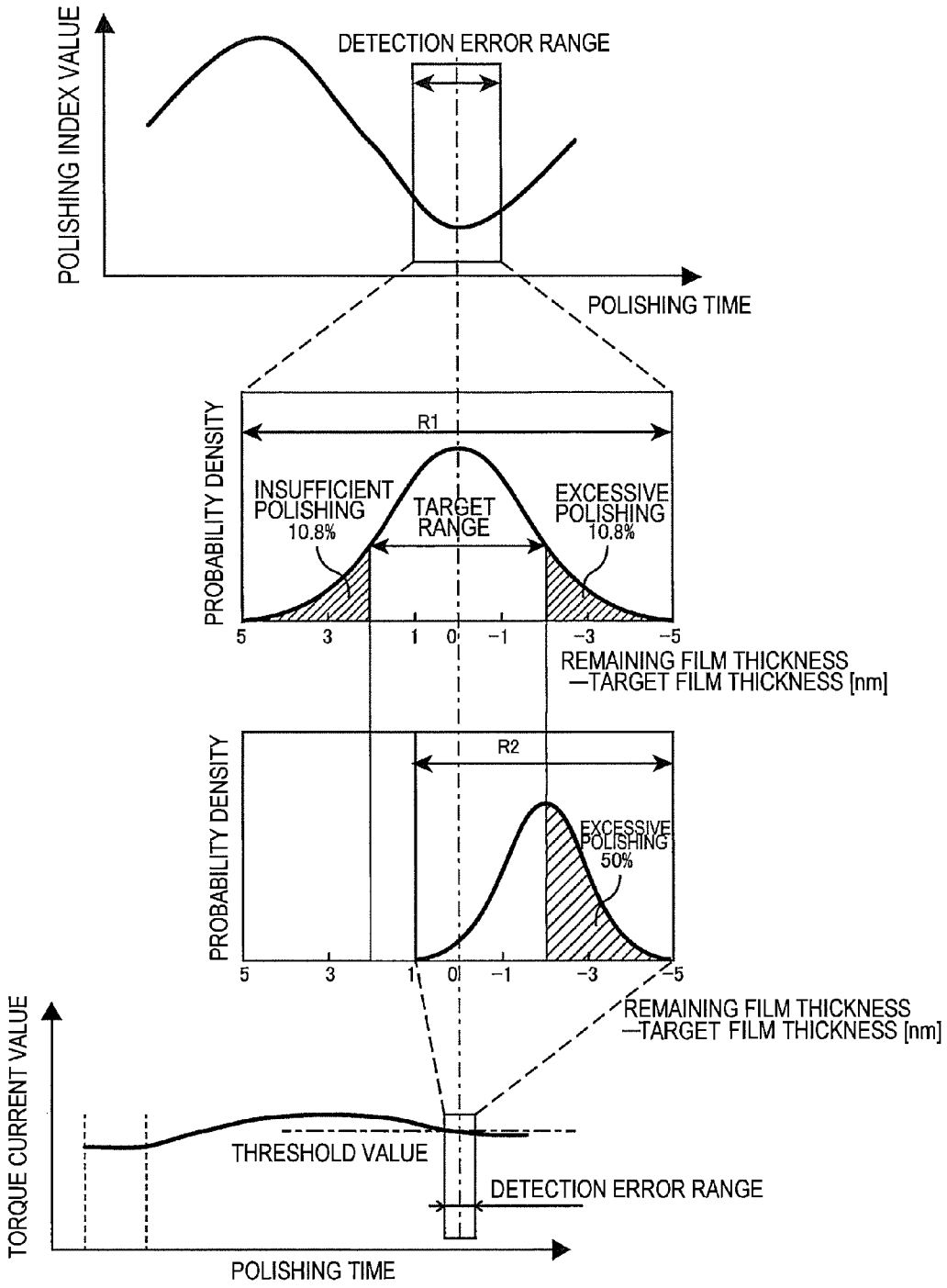
FIG. 11 is a diagram showing an example of a first detection error range and a second detection error range.

FIG. 11 is a diagram showing another example of the first detection error range R1 and the second detection error range R2. In this example, the center of the second detection error range R2 reaches a boundary of the target range (i.e., a right end on a time axis). In this case also, the probability of the excessive polishing is lowered as with the example shown in FIG. 10, because the factors of the detection error in the optical sensor and the torque current sensor are different. Therefore, the polishing end point can be detected more accurately. The same holds true for a case where the center of the second detection error range R2 for the end point detection based on the torque current lies outside the target range.

Figure 12:
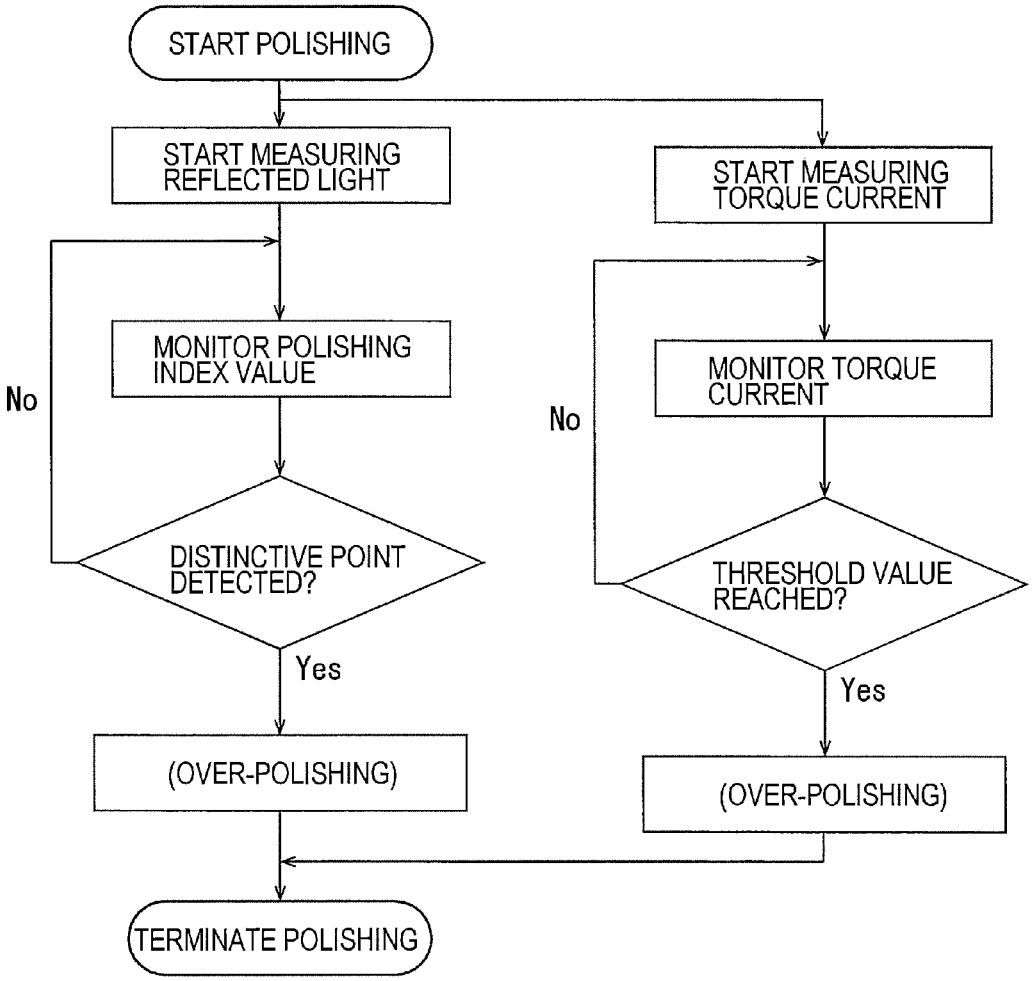
FIG. 12 is a flowchart illustrating an embodiment of the polishing end point detection method according to the present invention.

FIG. 12 is a flowchart illustrating an embodiment of the polishing end point detection method according to the present invention. When polishing of the wafer is started, the intensity measurement of the reflected light with use of the optical sensor 40 and the measurement of the torque current are started. The processor 18 produces the polishing index value from the optical data obtained from the optical sensor 40 and monitors the polishing index value. Simultaneously, the processor 18 monitors the torque current value. The processor 18 may monitor the torque current value outputted from a driver (i.e., an inverter) for driving the table motor 25, instead of the torque current value measured by the ammeter 35.

The processor 18 judges whether or not the distinctive point (i.e., the local maximal point or the local minimal point) of the polishing index value has appeared, and simultaneously judges whether or not the torque current has reached the predetermined threshold value. Either the point of time when the distinctive point of the polishing index value has appeared or the point of time when the torque current has reached the predetermined threshold value, whichever comes first, is determined to be the polishing end point. After the determination of the polishing end point, the wafer may be further polished (i.e., over-polished) for a predetermined time, if necessary. Then, polishing of the wafer is terminated.

Generally, the polishing end point detection based on the torque current value is advantageous in the case where an area percentage of the different-type of film to be detected (i.e., the lower film) is large and in the case of using a polishing liquid having chemical characteristics that make a polishing rate (or a removal rate) different greatly between the upper film and the lower film. This is because the frictional force greatly changes when the lower film has appeared on the wafer surface. The polishing end point detection with use of the optical sensor 40 is advantageous in that a polished state of the upper film can be detected before the lower film is exposed. The present invention can realize the more accurate polishing end point by using the combination of these two polishing end point detection techniques.

The above-described embodiments execute the polishing end point detection based on the torque current and the polishing end point detection based on the polishing index value under OR condition, while another embodiment may execute the polishing end point detection based on the torque current and the polishing end point detection based on the polishing index value under AND condition. Specifically, the polishing end point may be determined on the condition that the torque current value has reached the predetermined threshold value and the distinctive point of the polishing index value has appeared. In other words, the point of time when the torque current value has reached the predetermined threshold value or the point of time when the distinctive point of the polishing index value has appeared, whichever comes later, is determined to be the polishing end point. This polishing end point detection under the AND condition is effective in a wafer polishing process in which the insufficient polishing should be avoided.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus for polishing a substrate having a film formed thereon, said apparatus comprising:

a polishing table for supporting a polishing pad;

a table motor configured to rotate the polishing table;

a top ring configured to press the substrate against the polishing pad;

an optical sensor configured to irradiate the substrate with light and measure intensity of reflected light from the substrate; and a processor configured to produce, from the intensity of the reflected light, a polishing index value that varies in accordance with a thickness of the film, the processor being configured to monitor a torque current value of the table motor and the polishing index value and determine a polishing end point based on a point of time when the torque current value has reached a predetermined threshold value or a point of time when a predetermined distinctive point of the polishing index value has appeared, whichever comes first, wherein:

the processor stores therein a first detection error range determined from a difference between a predetermined target film thickness and a film thickness when the predetermined distinctive point of the polishing index value has appeared, and a second detection error range determined from a difference between the predetermined target film thickness and a film thickness when the torque current value has reached the predetermined threshold value;

each of the first detection error range and the second detection error range is a detection error range obtained from historical polishing data with respect to a substrate which is the same type as the substrate to be originally polished; and the predetermined threshold value is set such that the second detection error range overlaps with the first detection error range.

2. The polishing apparatus according to claim 1, wherein the processor is configured to determine the polishing end point which is either the point of time when the torque current value has reached the predetermined threshold value or the point of time when the predetermined distinctive point of the polishing index value has appeared, whichever comes first.

3. The polishing apparatus according to claim 1, wherein the processor is configured to determine the polishing end point which is a point of time when a predetermined time has elapsed from either the point of time when the torque current value has reached the predetermined threshold value or the point of time when the predetermined distinctive point of the polishing index value has appeared, whichever comes first.

4. The polishing apparatus according to claim 1, further comprising:

a polishing liquid supply nozzle configured to supply slurry onto the polishing pad.

5. A polishing apparatus for polishing a substrate having a film formed thereon, said apparatus comprising:

a polishing table for supporting a polishing pad;

a table motor configured to rotate the polishing table;

a top ring configured to press the substrate against the polishing pad;

a sensor configured to obtain a signal containing a thickness information of the film; and a processor configured to produce from the signal a polishing index value that varies in accordance with a thickness of the film, the processor being configured to monitor a torque current value of the table motor and the polishing index value and determine a polishing end point based on a point of time when the torque current value has reached a predetermined threshold value or a point of time when a predetermined distinctive point of the polishing index value has appeared, whichever comes first, wherein:

the processor stores therein a first detection error range determined from a difference between a predetermined target film thickness and a film thickness when the predetermined distinctive point of the polishing index value has appeared, and a second detection error range determined from a difference between the predetermined target film thickness and a film thickness when the torque current value has reached the predetermined threshold value;

each of the first detection error range and the second detection error range is a detection error range obtained from historical polishing data with respect to a substrate which is the same type as the substrate to be originally polished; and the predetermined threshold value is set such that the second detection error range overlaps with the first detection error range.

6. A polishing method for polishing a substrate having a film formed thereon, said method comprising:

rotating a polishing table supporting a polishing pad by a table motor;

pressing the substrate against the polishing pad by a top ring;

irradiating the substrate with light and measuring intensity of reflected light from the substrate;

producing, from the intensity of the reflected light, a polishing index value that varies in accordance with a thickness of the film;

monitoring a torque current value of the table motor and the polishing index value; and determining a polishing end point based on a point of time when the torque current value has reached a predetermined threshold value or a point of time when a predetermined distinctive point of the polishing index value has appeared, whichever comes first, wherein:

the predetermined threshold value is set such that a second detection error range overlaps with a first detection error range;

the first detection error range is determined from a difference between a predetermined target film thickness and a film thickness when the predetermined distinctive point of the polishing index value has appeared, and the second detection error range is determined from a difference between the predetermined target film thickness and a film thickness when the torque current value has reached the predetermined threshold value; and each of the first detection error range and the second detection error range is a detection error range obtained from historical polishing data with respect to a substrate which is the same type as the substrate to be originally polished.

7. The polishing method according to claim 6, wherein the determining of the polishing end point comprises determining the polishing end point which is either the point of time when the torque current value has reached the predetermined threshold value or the point of time when the predetermined distinctive point of the polishing index value has appeared, whichever comes first.

8. The polishing method according to claim 6, wherein the determining of the polishing end point comprises determining the polishing end point which is a point of time when a predetermined time has elapsed from either the point of time when the torque current value has reached the predetermined threshold value or the point of time when the predetermined distinctive point of the polishing index value has appeared, whichever comes first.

9. The polishing method according to claim 6, wherein rotating of the polishing table is performed while supplying slurry onto the polishing pad.

10. A polishing method for polishing a substrate having a film formed thereon, said method comprising:

rotating a polishing table supporting a polishing pad by a table motor;

pressing the substrate against the polishing pad by a top ring;

obtaining a signal containing a thickness information of the film;

producing from the signal a polishing index value that varies in accordance with a thickness of the film;

monitoring a torque current value of the table motor and the polishing index value; and determining a polishing end point based on a point of time when the torque current value has reached a predetermined threshold value or a point of time when a predetermined distinctive point of the polishing index value has appeared, whichever comes first, wherein:

the predetermined threshold value is set such that a second detection error range overlaps with a first detection error range;

the first detection error range is determined from a difference between a predetermined target film thickness and a film thickness when the predetermined distinctive point of the polishing index value has appeared, and the second detection error range is determined from a difference between the predetermined target film thickness and a film thickness when the torque current value has reached the predetermined threshold value; and each of the first detection error range and the second detection error range is a detection error range obtained from historical polishing data with respect to a substrate which is the same type as the substrate to be originally polished.

* * * * *